United States Patent [19]

Benjamin et al.

[11] Patent Number: 4,983,310

[45] Date of Patent: Jan. 8, 1991

[54] MULTIFUNCTIONAL LUBRICANTS AND MULTIFUNCTIONAL ADDITIVES FOR LUBRICANTS

[75] Inventors: Linda A. Benjamin, Horsham, Pa.; Andrew G. Horodysky, Cherry Hill, N.J.; Derek A. Law, Yardley; Shi-Ming Wu, Newtown, both of Pa.

[73] Assignee: Mobil Oil Corporation, Fairfax, Va.

[21] Appl. No.: 292,080

[22] Filed: Dec. 30, 1988

[51] Int. Cl.[5] ..... C10M 105/72; C10M 105/74

[52] U.S. Cl. ..... 252/32.7 E; 252/46.6

[58] Field of Search ..... 252/32.7 E, 397, 32.5, 252/32, 46.6, 46.7

[56] References Cited

U.S. PATENT DOCUMENTS

| | | | |
|---|---|---|---|
| 2,957,931 | 10/1960 | Hamilton et al. | 260/403 |
| 3,390,082 | 6/1968 | Le Suer | 252/32.7 E |
| 3,442,804 | 5/1969 | Le Suer | 252/32.7 E |
| 4,259,192 | 3/1981 | Lilburn | 252/32.7 E |
| 4,356,097 | 10/1982 | Papay | 252/33.4 |
| 4,532,057 | 7/1985 | Horodysky et al. | 252/49.8 |
| 4,584,112 | 4/1986 | Erdman | 252/32.7 E |
| 4,784,780 | 11/1988 | Farng | 252/327 E |
| 4,834,893 | 5/1989 | Doner | 252/32.7 E |

FOREIGN PATENT DOCUMENTS 2020455 11/1971 Fed. Rep. of Germany .

*Primary Examiner*—Olik Chaudhuri
*Assistant Examiner*—James M. Hunter, Jr.
*Attorney, Agent, or Firm*—A. J. McKillop; C. J. Speciale; H. M. Flournoy

[57] ABSTRACT

Hydrocarbyl thiophosphoric acid-phosphite derived olefin and polymeric olefin adducts are superior as lubricating fluid media with internal synergistic multifunctional antiwear, antioxidant properties, and as multifunctional extreme pressure/antiwear additives for both mineral and synthetic lubricating oils as well as fuels.

18 Claims, No Drawings

MULTIFUNCTIONAL LUBRICANTS AND MULTIFUNCTIONAL ADDITIVES FOR LUBRICANTS

BACKGROUND OF THE INVENTION

This invention relates to compositions of the matter comprising alkoxylated dihydrocarbyl dithiophosphoric acid-phosphite derived olefin and polymeric olefin adducts as unique multifunctional additives as well as multifunctional lubricants possessing inherent multifaceted internal synergism. These unique multifunctional additives in minor amounts are also highly useful additives for liquid hydrocarbon fuel compositions.

Lubricants, such as lubricating oils and greases, are subject to deterioration at elevated temperatures or upon prolonged exposure to the elements. Such deterioration is evidenced, in many instances, by an increase in acidity and in viscosity, and when the deterioration is severe enough, it can cause metal parts to corrode. Additionally, severe oxidation can lead to a loss of lubrication properties, and in especially severe cases this may cause complete breakdown of the device being lubricated. Many additives have been tried, however, many of them are only marginally effective except at high concentrations. Improved antioxidants are clearly needed.

Antioxidants or oxidation inhibitors are used to minimize the effects of oil deterioration that occur when hot oil is contacted with air. The degree and rate of oxidation will depend on temperature, air and oil flow rates and, of particular importance, on the presence of metals that may catalytically promote oxidation. Antioxidants generally function by prevention of chain peroxide reaction and/or metal catalyst deactivation. They prevent the formation of acid sludges, darkening of the oil and increases in viscosity due to the formation of polymeric materials.

Water (moisture) is another critical problem. In spite of even extraordinary precautionary efforts water is found as a film or in minute droplets in vessels containing various hydrocarbon distillates. This brings about ideal conditions for corrosion and damage of metal surfaces of the vessels and the materials contained therein. Also in the lubrication of internal combustion engines, for example, quantities of water are often present as a separate phase within the lubricating system. Another serious problem in respect to metallic surfaces in contact with adjacent metallic surfaces is the surface wear caused by the contact of such surfaces. One material capable of simultaneously effectively coping with such problems as these and providing simultaneous multifunctional characteristics, in addition to antioxidation and anticorrosion, such as EP/antiwear, antiwear and extreme pressure and friction modifying characteristics while maintaining fluid lubricity is highly desireous.

U.S. Pat. No. 4,532,057 discloses a lubricant and liquid fuel compositions containing a hydrogen phosphite-vicinal diol reaction product which provides additional protection to metals parts in contact by reducing the amount of friction.

The use of phosphorodithioate compositions, especially the corresponding salts of phosphorodithioate, such as zinc dialkylphosphorodithioates (commonly known as zinc dithiophosphates) have found widespread commercial use for several decades in engine oils as multifunctional antiwear, peroxide decomposing, and bearing corrosion inhibiting additives. U.S. Pat. No. 2,758,971 describes certain metal phosphites as having properties which prevent breakdown of lube oils at high temperatures and U.S. Pat. No. 4,356,097 discloses an engine crankcase oil containing a dihydrocarbyl hydrocarbyl phosphate which exhibits reduced friction.

The general peroxide catalyzed reaction of dialkyl hydrogen phosphites with conventional olefins to give phosphonate derivatives is known as disclosed in U.S. Pat. No. 2,957,931. The use of these materials as multifunctional additives in a variety of lubricant applicant applications is also known.

It is an object of this invention to provide additive reaction products which exhibit excellent lubricating properties in conjunction with good extreme pressure/antiwear, antioxidant and friction reducing properties.

SUMMARY OF THE INVENTION

This invention is directed to compositions containing small additive concentrations of the reaction products of polymeric olefins such as polyisobutene, polyoctene, polydecene or functionalized olefins such as oleyl oleate with various functionalized dialkyldithiophosphoric acid derived phosphites and to compositions comprising from zero to 100% of said reaction products as lubricant fluids themselves.

The incorporation of the functionalized phosphite derivatives onto the backbone of olefinic oils provides the basis for the unique internal synergistic extreme pressure/antiwear activity thermal stability and lubricity of the instant compositions. Furthermore, functionalized phosphite-adducts contribute additional friction reducing, rust inhibiting and hydrolytic stabilizing benefits which are also believed to be enhanced as a result of the novel multidimensional internal synergism.

DETAILED DESCRIPTION OF THE INVENTION

The use of these functionalized compositions, as detailed in this application, as lubrication fluids and additives in either a mineral or synthetic lubricant is unique and provides unprecedented performance benefits due to the inherent internal synergism. The process of enhancement of lubricating properties via the addition of these compositions to either mineral or synthetic lubricants is also believed to be unique. For example, the process of improving wear, friction, corrosion inhibition and thermal stability of a high temperature, high viscosity olefin oligomer via the addition of up to 100% of an adduct of an alkoxylated dihydrocarbyl phosphorodithioate-derived phosphite and polymeric olefins or functionalized olefins, is unique and not manifested in prior art. Additionally, the combination of lubricant formulations containing the above compositions with any of the following supplemental additives: dispersants, detergents, viscosity index improvers, EP/antiwear additives, antioxidants, pour depressants, emulsifiers, demulsifiers, corrosion inhibitors, antirust inhibitors, antistaining additives, friction modifiers, and the like are novel.

Any post-reactions of these unique functionalized phosphite olefins with small amounts of functionalized olefins such as vinyl esters, vinyl ethers, acrylates and methacrylates are also believed to be novel.

Incorporation of functionalized phosphites onto the backbone of the polymeric oils such as polyisobutylene or functionalized olefins such as oleyl oleate offers unique advantages over conventional formulated lubricants where volatility or extraction is considered to be important. These functionalized compositions have improved thermal stability over comparable polyisobutylene olefins. Therefore, the products from novel functionalized phosphites with polymeric olefins or functionalized olefins are unique and not evident in prior art.

For example, polymeric or functionalized olefin adducts of alkoxylated dialkyldithiophosphoric acid phosphites (I) possess extreme pressure/antiwear, antioxidant, and friction reducing activities. Both the phosphorodithioate moiety especially these sulfur, nitrogen, and oxygen containing untraditional phosphorodithioates such as (II) and the olefin moiety provides the basis for the unique internal synergistic antioxidant activity, thermal stability, and lubricity. The phosphorodithioate group contributes additional antiwear properties to these functionalized lubricants, and the dithiophosphoric acids contributes additional friction reducing, rust inhibiting, antioxidant, and antiwear properties. All of these beneficial properties are enhanced as a result of this novel multidimensional internal synergism.

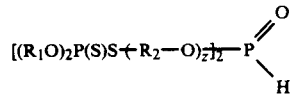

(I)

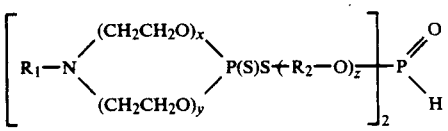

(II)

where $R_1$ is $C_1$ to about $C_{30}$, $R_2$ is a divalent hydrocarbylene group containing from 2 to about 30 carbon atoms, x and y independently equal from 1 up to about 50, and z is from 1 to about 10.

$R_1$ is more preferably from $C_3$ to $C_{12}$, $R_2$ is more preferably from $C_2$ to $C_{18}$ x and y are more preferably from 1 to about 6; z is preferably from 1 to 5; $R_1$ can optionally contain S, N, or O moieties.

This unique multidimensional internal synergism concept is believed to be applicable to similar structures containing (a) olefin moiety, (b) phosphite derived phosphorodithioate moiety, or any other phosphorus and sulfur containing groups, and (c) sulfur/oxygenate/nitrogenate-containing substituents to the uncommon phosphorodithioate groups within the same molecule. Internal synergism of the combined phosphite and phosphorodithioate groups are expected.

All of the above mentioned olefin-phosphite adducts exhibit beneficial properties from the unique olefin in combination with those properties unique to a given functionalized phosphite. This combination provides for a novel structural class and a unique multifaceted synergistic set of properties. The use of these compositions of matter to improve lubricant properties either as a fully functional lubricant fluid itself or as a partial fluid replacement or as additives for lubricants is also believed to be novel.

The phosphite used can be chosen from either of the above structures (I and II) and similar structures.

Any suitable olefin or functionalized olefin may be used as for example, $C_2$ to about $C_{80}$ hydrocarbyl olefins or oligomers or polymers thereof, or functionalized olefins containing O, S or N moieties are highly useful. The preferred olefins are polymeric oils such as polyisobutylene or polypropylene oligomers containing at least one olefinic linkage and having a MW of from about 400 to about 4,000. Decene trimer and tetramer derived oils are the generally preferred polymeric oils. The preferred olefinic oils contain at least 30 carbon atoms and may include functionalized olefins containing sulfur, oxygen and/or nitrogen such as an olefinic ester, e.g., oleyl oleate, pentaerythritol tri-or tetra oleate, trimetholoproplene mono, di, or trioleate, oleyl stearate, and the like. Olefins such as 1-decene, 1-dodecene, 1-octadecene and the like can also be used.

Generally speaking, the materials of the present invention are prepared by reacting a suitable olefin or olefin oil as described above, such as polybutene, polypropylene or polyoctene or polydecene or oleyl oleate or 1-decene with an alkoxylated dihydrocarbyl dithiophosphoric acid phosphite such as prosphite of butoxylated di-O,O-ethyl phosphorodithioate in the presence of a catalyst such as di-tertiary butyl peroxide. The reactants are preferably used in equimolar quantities that is, the reaction mixture should contain at least one mole each of the phosphite and the olefin. They can also however be used in a molar ratio of from 1:1 to about 1:3 of phosphite to olefin, an excess of olefin to phosphite is often preferred.

The temperature of reaction will depend upon the solvent, if used, the reaction will generally be run at the reflux temperature. The temperature is not believed to be critical and the reaction can be run over a wide range of from about 50° C. to about 225° C., preferably from about 80° C. to about 150° C. Although a solvent is not required, examples of useful solvents are toluene, benzene, xylene, cyclohexane, ethanol and the like. It should be one in which the products are soluble and which can be relatively easily removed, although in some cases a lubricating oil can be used as a solvent and diluent.

Times of reaction are not critical, but they will vary depending upon the size and complexity of the reactants. Under normal conditions, the reaction with the contemplated reactants can be completed in from about 1 hour to about 10 hours, preferably from about 2 hour to about 6 hours.

The products of the invention can be used with lubricating oils or greases to the extent of from about 0.1% to about 10% by weight of the total composition, preferably from about 0.2% to about 2% and with fuels to the extent of from about 5 lbs. to about 250–500 lbs. per 1000 bbls. of fuel. However, when used as lubricant fluids of partial replacement fluid the products in accordance herewith may be used in amounts up to 100% or preferably at concentrations of about 10 to 90 to 100%. Furthermore, other additives, such as detergents, antioxidants, antiwear agents and the like may be present. These can include phenates, sulfonates, polymeric succinimides, zinc dialkyl or aryl dithiophosphates, polymers, calcium and magnesium salts, polymeric viscosity index improving additives such as olefin copolymers, sulfurized olefins and the like.

The lubricants contemplated for use with the alkoxylated dihydrocarbyl dithiophosphoric acid-phosphite derived olefins and polymeric olefins adducts herein disclosed, include mineral and synthetic hydrocarbon oils of lubricating viscosity, mixtures of mineral oils and synthetic oils and greases from any of these, including the mixtures. The synthetic hydrocarbon oils include long-chain alkanes such as cetanes and olefin polymers such as oligomers of hexane, octene, decene, and dodecene, etc. These phosphites are especially effective in synthetic oils formulated using mixtures of synthetic hydrocarbon olefin oligomers and lesser amounts of hydrocarbyl carboxylate ester fluids. The other synthetic oils, which can be used alone with the phosphorus compounds of this invention, or which can be mixed with a mineral or synthetic hydrocarbon oil, include (1) fully esterified ester oils, with no free hydroxyls, such as pentaerythritol esters of monocarboxylic acids having 2 to 20 carbon atoms, trimethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

A wide variety of thickening agents can be used in the greases of this invention. Included among the thickening agents are alkali and alkaline earth metal soaps of fatty acids and fatty materials having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyanines, indanthrene, pigments such as perylimides, pyromellitdiimides, and ammeline.

The preferred thickening, gelling agents employed in the grease compositions are essentially hydrophobic clays. Such thickening agents can be prepared from clays which are initially hydrophilic in character, but which have been converted into a hydrophobic condition by the introduction of long chain hydrocarbon radicals into the surface of the clay particles; prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3 percent to 15 percent by weight of the total grease composition.

The liquid fuels contemplated include the liquid hydrocarbons, such as gasoline, fuel oil and diesel oil and the liquid alcohols such as methyl alcohol and ethyl alcohol. The fuels also include mixtures of alcohols as well as mixtures of alcohols and liquid hydrocarbons such as gasohol.

Having described the invention in general aspects, the following Examples are offered as specific illustrations and in no way are intended to limit the scope of the present invention. The reactants can either be made in any manner known to those of ordinary skill in the art or obtained through normal commercial channels.

EXAMPLE 1

Into a four-neck round bottom flask equipped with a mechanical stirrer, condenser, thermometer, nitrogen purge inlet and outlet, were added 92 grams (0.20 mol) of unsaturated oil polyisobutene (Amoco Indopol L-100) and heated to 120° C., and a 30 ml toluene solution of butoxylated di-O-,O-ethyl phosphorodithioate of (82 grams, 0.10 mol) and di-tert-butyl peroxide (5.2 grams, 3.0 wt %) were added dropwise. At the end of the addition, the reaction mixture was heated to reflux for four hours, then volatiles were removed under vacuum at 130° C. to give 180 grams of brown fluid.

EXAMPLE 2

The same reaction conditions as described in Example 1 were used in this preparation, a 20 ml toluene solution of butoxylated di-O,O-ethyl phosphorodithioate of (41 grams, 0.05 mol) and di-tert-butyl peroxide (2.0 grams, 3.0 wt %) was added dropwise to oleyl oleate (26.6 grams, 0.05 mol). A light brown fluid of 69 grams was obtained from the reaction.

EXAMPLE 3

The same reaction conditions as described in Example 1, a 30 ml toluene solution of butoxylated di-O,O-ethyl phosphorodithioate (82 grams, 0.10 mol) and di-tert-butyl peroxide (4.0 grams, 3.0 wt %) was added to 1-decene (28 gram, 0.20 mol). The reaction yielded 104 grams of light brown fluid.

The products of the above examples were evaluated as lubricant additives at 1.0 wt % concentration in ASTM test mineral oil. The results were compared to the test oil without additive. These data were obtained on the Four-Ball-Wear Apparatus (2000 rpm, 200° F., 60 kg). ASTM Method D2266. For additional test details, see U.S. Pat. No. 4,761,482.

Four-Ball Wear Test

| 1.0 wt. % additive in mineral based oil (80% solvent paraffinic bright, 20% solvent paraffinic neutral mineral oils) | Wear Scar (mm) | $K \times 10^3$ K factor* |
|---|---|---|
| 0 | 3.51 | 4995 |
| Example 1 | 0.05 | 1.38 |
| Example 2 | 0.46 | 0.92 |

-continued

| Four-Ball Wear Test | | |
|---|---|---|
| Example 3 | 0.55 | 2.35 |

*Wear Factor $Kt = \frac{X}{PVT}$

Kt = Wear factor (based on thickness change) (express as whole number times 10)
X = Thickness change, in (wear)
P = Contact Pressue, psi
V = Velocity, ft/min
T = Test Duration, h As shown above, the examples are very concentration-effective antiwear additives.

The coupling of the polymeric oils or the functionalized olefins with the non-traditional multifunctional phosphite derivatives described in this application leads to novel lubricants and lubricant additives with enhanced oxidative stability, reduced wear, improved rust inhibition and increased load carrying capabilities. In addition, since the phosphite containing a phosphorodithioate moiety is grafted onto an olefin backbone undesirable properties such as volatility and staining are eliminated. Furthermore, these materials are economically feasible and can be easily implemented into existing equipment as multifunctional lubricants or as multifunctional additives in mineral or synthetic base stocks.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A lubricant composition comprising a major amount of an oil of lubricating viscosity or grease or other solid lubricant prepared therefrom and a minor multifunctional extreme pressure, antiwear, antioxidant and friction reducing amount of a reaction product of a polymeric olefin or functionalized olefin and an alkoxylated dihydrocarbyl dithiophosphoric acid derived phosphite wherein said phosphite reactant is selected from phosphites having the following structures:

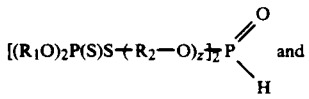

(I)

and

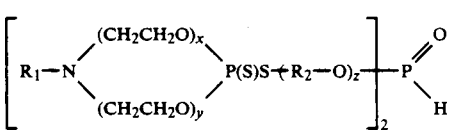

(II)

where $R_1$ is $C_1$ to about $C_{30}$ hydrocarbyl or where $R_1$ is $C_1$ to about $C_{30}$ hydrocarbyl containing oxygen, sulfur, or nitrogen moieties and $R_2$ is a divalent hydrocarbylene group containing from 2 to about 30 carbon atoms, x and y each independently equal from 1 to about 50, and z is from 1 to about 10 and wherein the molar ratio of phosphite to olefin varies from about 1:1 to about 1:3, the reaction temperature varies from about 80 to about 225° C., the pressure varies from ambient or atmospheric to slightly higher than atmospheric pressure and the reaction time varies from about 1 to about 10 hours or more.

2. The composition of claim 1 wherein the olefins are selected from $C_2$ to about $C_{60}$ hydrocarbyl olefins and the polymeric olefins are selected from oligomers or polymers of said hydrocarbyl olefins containing at least one olefinic linkage or functionalized olefins containing sulfur, oxygen or nitrogen, or olefinic esters, and olefinic ethers or mixtures thereof.

3. The composition of claim 2 wherein the olefin is selected from the group consisting of polybutene, polyoctene, polydecene or mixtures thereof.

4. The composition of claim 2 wherein the olefin is polyisobutene.

5. The composition of claim 2 wherein the olefin is 1-decene.

6. The composition of claim 1 wherein the olefinic reactant is a functionalized olefin containing O, N or S moieties.

7. The composition of claim 1 wherein the olefin is a polymeric oil selected from the group consisting of polyisobutylene, polypropylene, octene or decene oligomers or mixtures thereof having at least about 20 carbon atoms and optionally containing O, S or N moieties and having a MW of from about 400 to about 4,000.

8. The composition of claim 1 wherein the phosphite has the structure therein as structure I.

9. The composition of claim 1 wherein the phosphite has the structure therein as structure II.

10. The composition of claim 1 wherein the reactants are polyisobulene and butoxylated di-O,O-ethyl phosphorodithioate of.

11. The composition of claim 1 wherein the reactants are 1-decene and butoxylated di-O,O-ethyl phosphorodithioate of.

12. The composition of claim 1 wherein the lubricant is selected from the group consisting of (1) a mineral oil (2) a synthetic oil or a mixture of synthetic oils, (3) a mixture of (1) and (2) and (4) or a grease of any one of (1), (2), or (3).

13. The composition of claim 12 wherein the lubricant is (1).

14. The composition of claim 12 wherein the lubricant is (2).

15. The composition of claim 12 wherein the lubricant is (3).

16. The composition of claim 12 wherein the lubricant is (4) a grease formulated from any of (1), (2) or (3) or mixtures thereof.

17. A lubricant composition comprising from about 10% to about 100% of a product of reaction as described in claim 1.

18. A lubricant composition comprising from about 50% to about 100% of said product of reaction as described in claim 1.

* * * * *